US010780701B2

(12) United States Patent
Fukuta et al.

(10) Patent No.: US 10,780,701 B2
(45) Date of Patent: Sep. 22, 2020

(54) LIQUID EJECTING APPARATUS

(71) Applicant: SEIKO EPSON CORPORATION, Tokyo (JP)

(72) Inventors: Hiroya Fukuta, Nagano (JP); Takeshi Yoshida, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/260,218

(22) Filed: Jan. 29, 2019

(65) Prior Publication Data

US 2019/0232663 A1 Aug. 1, 2019

(30) Foreign Application Priority Data

Jan. 31, 2018 (JP) ..... 2018-015465

(51) Int. Cl.
*B41J 2/165* (2006.01)
*B41J 2/175* (2006.01)
*B41J 2/21* (2006.01)

(52) U.S. Cl.
CPC ..... *B41J 2/16552* (2013.01); *B41J 2/16505* (2013.01); *B41J 2/16523* (2013.01); *B41J 2/16532* (2013.01); *B41J 2/17509* (2013.01); *B41J 2/2117* (2013.01); *B41J 2002/16502* (2013.01); *B41J 2002/16573* (2013.01)

(58) Field of Classification Search
CPC ..... B41J 2/16552; B41J 2/16523
See application file for complete search history.

(56) References Cited

U.S. PATENT DOCUMENTS

2002/0171706 A1* 11/2002 Miyamoto ..... B41J 2/16532 347/29
2011/0242207 A1* 10/2011 Nakazawa ..... B41J 2/16532 347/30
2016/0288506 A1* 10/2016 Tamaki ..... B41J 2/16508
2017/0320326 A1* 11/2017 Kawabata ..... B41J 2/16505
2018/0004462 A1* 1/2018 Arakane ..... B41J 2/1652
2019/0232664 A1* 8/2019 Fukuta ..... B41J 2/2117

FOREIGN PATENT DOCUMENTS

JP 2003-320674 A 11/2003
JP 2010-058400 A 3/2010
JP 2010-240997 A 10/2010
JP 2017-196794 A 11/2017

OTHER PUBLICATIONS

The Extended European Search Report for the corresponding European Patent Application No. 19154431.1 dated Jun. 26, 2019.

* cited by examiner

*Primary Examiner* — Shelby L Fidler
(74) *Attorney, Agent, or Firm* — Global IP Counselors, LLP

(57) ABSTRACT

A printer includes a head including an ink ejecting unit for ejecting ink from a nozzle, a waste liquid flow path that is a flow path of ink sucked from the nozzle, a suction unit that performs an ink suction operation of sucking the ink from the nozzle via the waste liquid flow path, and a cleaning operation of sucking cleaning liquid from the nozzle via the waste liquid flow path, and a control unit that controls the suction unit so as to vary a suction amount of the cleaning liquid depending on an elapsed time from when the ink suction operation is performed, when the cleaning operation is performed.

6 Claims, 6 Drawing Sheets

| CLEANING OPERATION | SUCTION AMOUNT OF CLEANING LIQUID |
|---|---|
| REGULAR CLEANING OPERATION | FIRST SUCTION AMOUNT |
| TEMPORAL CLEANING OPERATION | THIRD SUCTION AMOUNT |

LIQUID EJECTING APPARATUS

BACKGROUND

1. Technical Field

The present invention relates to a liquid ejecting apparatus including a waste liquid flow path which is a flow path of ink sucked from a nozzle of an ink ejecting unit.

2. Related Art

In the related art, JP-A-2017-196794 is known as this type of technology. In JP-A-2017-196794, the liquid ejecting apparatus that includes the waste liquid flow path which is the flow path of ink sucked from the nozzle of a head and cleans the waste liquid flow path by supplying cleaning liquid to the waste liquid flow path, is disclosed.

However, since ink remaining in a waste liquid flow path solidifies with the lapse of time, it is necessary to clean the waste liquid flow path by cleaning liquid, and there is room for improvement on how to use the cleaning liquid.

SUMMARY

According to an aspect of the invention, there is provided a liquid ejecting apparatus including an ink ejecting unit that ejects ink from a nozzle, a waste liquid flow path that is a flow path of the ink sucked from the nozzle, a suction unit that performs an ink suction operation of sucking the ink from the nozzle via the waste liquid flow path, a cleaning unit that performs a cleaning operation of supplying cleaning liquid from a cleaning liquid storage unit that stores the cleaning liquid to the waste liquid flow path, and a control unit that controls the cleaning unit so that a supply amount of the cleaning liquid varies depending on an elapsed time from when the ink suction operation is performed, when the cleaning operation is performed.

According to this configuration of the invention, when the cleaning operation is performed, since the cleaning unit is controlled so that the supply amount of the cleaning liquid varies according to an elapsed time from when the ink suction operation is performed, it is possible to clean the waste liquid flow path by the cleaning liquid of an amount suitable for the elapsed time. Accordingly, it is possible to suppress an excessive use of the cleaning liquid, and, as a result, it is possible to suppress a use amount of the cleaning liquid. An amount of the cleaning liquid to be used may be varied depending on a type of ink sucked by the ink suction operation and the elapsed time from when the ink suction operation is performed.

In the liquid ejecting apparatus, the control unit may cause the cleaning unit to perform the cleaning operation with a reference supply amount when a reference time elapses from when the ink suction operation is performed, and cause the cleaning unit to perform the cleaning operation with a supply amount smaller than the reference supply amount when a trigger for starting the cleaning operation is generated, before the reference time elapses.

According to this configuration, by the cleaning operation performed when the trigger for starting the cleaning operation is generated, it is possible to suppress a use amount of cleaning liquid as compared to the cleaning operation performed when the reference time elapses from when the ink suction operation is performed.

In the liquid ejecting apparatus, the trigger for starting the cleaning operation may be at least one of power OFF of the liquid ejecting apparatus and an operation for starting the cleaning operation.

According to this configuration, in the cleaning operation performed when at least one of power OFF of the liquid ejecting apparatus and an operation for starting the cleaning operation is generated, it is possible to suppress the use amount of the cleaning liquid.

In the liquid ejecting apparatus, the suction unit may function as the cleaning unit by sucking the cleaning liquid from a cleaning liquid storage unit via the waste liquid flow path.

According to this configuration, since the suction unit functions as the cleaning unit, it is possible to simplify a device configuration.

In the liquid ejecting apparatus, the liquid ejecting apparatus may further include a cleaning liquid ejecting unit that ejects the cleaning liquid from the nozzle, and the suction unit may suck the cleaning liquid from the nozzle of the cleaning liquid ejecting unit via the waste liquid flow path.

According to this configuration, similar to the suction of the ink from the nozzle of the ink ejecting unit, by sucking the cleaning liquid from the nozzle of the cleaning liquid ejecting unit, it is possible to supply the cleaning liquid.

In the liquid ejecting apparatus, the ink ejecting unit and the cleaning liquid ejecting unit may be provided in a single head.

According to this configuration, since it is possible to perform the ejecting of the ink by the ink ejecting unit and the ejecting of the cleaning liquid by the cleaning liquid ejecting unit with the single head, it is possible to simplify a device configuration.

In the liquid ejecting apparatus, the liquid ejecting apparatus may further include an acquisition unit that acquires an environment temperature, and the control unit may control the cleaning unit so that the supply amount of the cleaning liquid varies depending on the acquired environment temperature.

According to this configuration, since the cleaning unit is controlled so that the supply amount of the cleaning liquid varies depending on not only the elapsed time from when the ink suction operation is performed but also the environment temperature, it is possible to more effectively suppress the use amount of the cleaning liquid.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, an embodiment of the invention will be described with reference to the drawings. In the present embodiment, as an example of a liquid ejecting apparatus, an ink jet printer 1 is exemplified.

Figure 1:
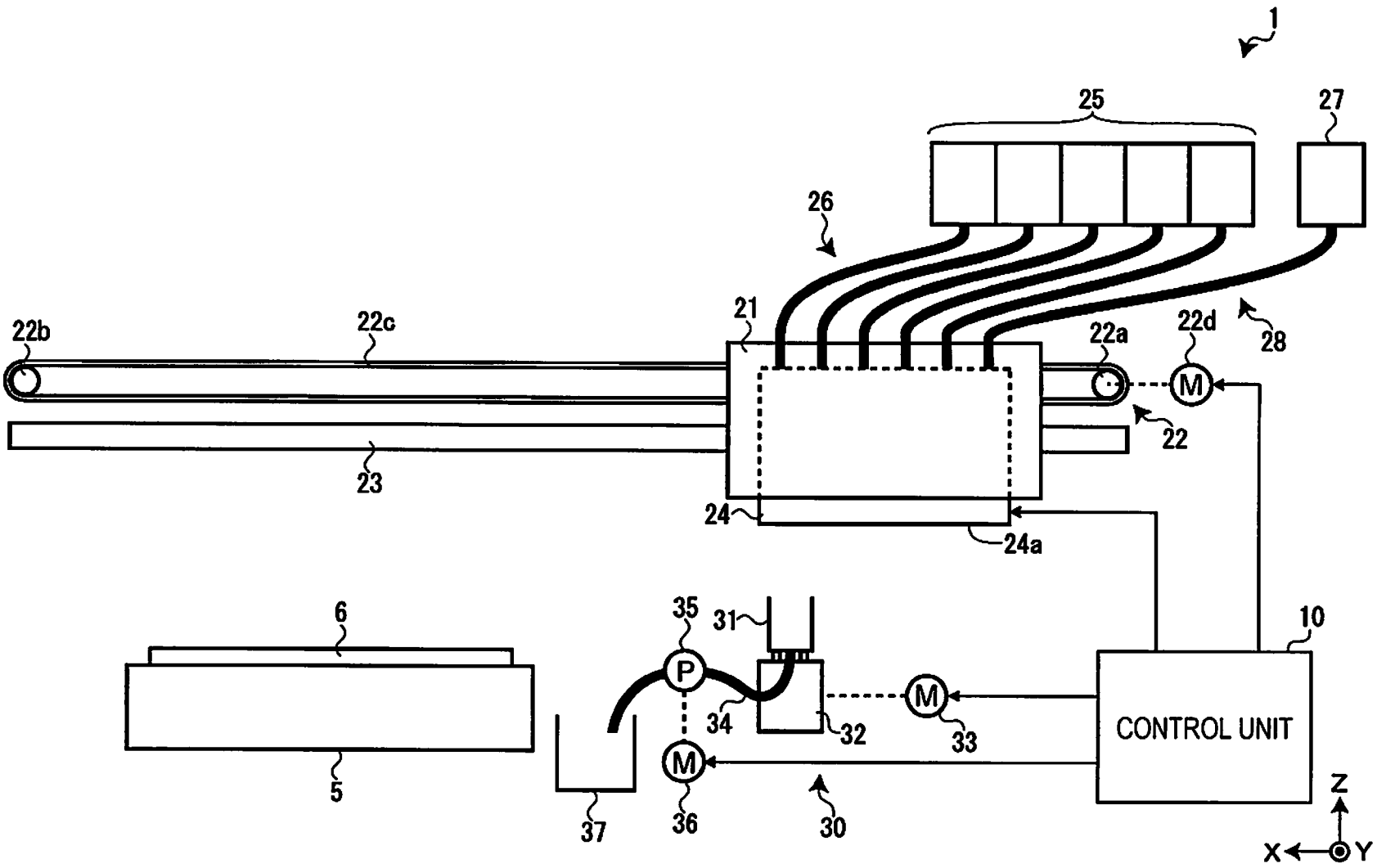
FIG. 1 is a diagram illustrating a schematic configuration of a printer according to an embodiment of the invention.

FIG. 1 is a diagram illustrating a schematic configuration of the printer 1 according to an embodiment of the invention. The printer 1 includes a support base 5, a carriage 21, a carriage moving mechanism 22, a guide shaft 23, a head 24, an ink cartridge 25, an ink supply flow path 26, a cleaning liquid cartridge 27, a cleaning liquid supply flow path 28, a suction unit 30, and a control unit 10.

The support base 5 supports a print medium 6. The print medium 6 is transported in a Y direction (depth direction in FIG. 1) by a medium transporting mechanism (not illustrated) in a state of being supported by the support base 5. The guide shaft 23 extending along an X direction (horizontal direction in FIG. 1) is bridged above the support base 5. The carriage 21 mounts the head 24 and is reciprocated in the X direction by the carriage moving mechanism 22 while being supported by the guide shaft 23.

The carriage moving mechanism 22 includes a driving pulley 22*a*, a driven pulley 22*b*, a timing belt 22*c*, and a carriage motor 22*d*. Power is transmitted from the carriage motor 22*d* to the driving pulley 22*a* and an endless timing belt 22*c* partly connected to the carriage 21 is stretched between the driving pulley 22*a* and the driven pulley 22*b*. That is, the carriage 21 reciprocates in the X direction via the timing belt 22*c* by driving force of the carriage motor 22*d*.

Figure 2:
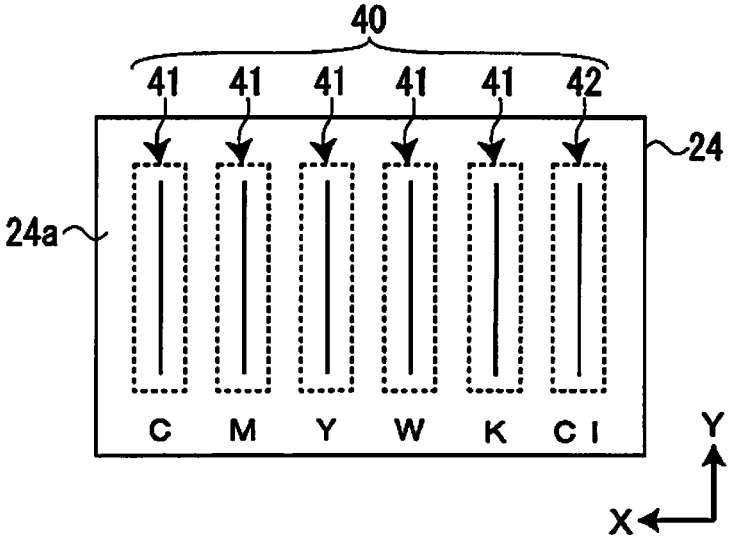
FIG. 2 is a diagram illustrating an array of nozzles provided in a head.

Meanwhile, the head 24 includes a nozzle forming surface 24*a* on which a plurality of nozzles are formed. As illustrated in FIG. 2, a nozzle row 40 configured with a plurality of nozzles arranged along the Y direction and at predetermined intervals in the X direction is formed on the nozzle forming surface 24*a* of the head 24. The number of nozzles included in each nozzle row 40 and the nozzle intervals in the Y direction are all common.

As the nozzle row 40, the head 24 illustrated in FIG. 2 includes a plurality of ink nozzle rows 41 for ejecting ink for each ink color and one cleaning liquid nozzle row 42 for ejecting the cleaning liquid. Here, the cleaning liquid refers to liquid for cleaning a waste liquid flow path 34 (which will be described below). The cleaning liquid is not particularly limited as long as it can dissolve a solidified ink. However, for example, solvent of ink can be used. Each of the plurality of ink nozzle rows 41 corresponds to ink colors of cyan, magenta, yellow, white, and black. The white ink is an ink containing a white pigment component and is a kind of white liquid. As white pigment, for example, titanium dioxide can be suitably used. In addition, white is a color that is visually perceived as white and is not limited to achromatic white. However, for example, the white means that it also includes a slightly tinged white called off white or ivory white.

Arrangement of the colors of the plurality of ink nozzle rows 41, the number of the ink nozzle rows 41, a position of the cleaning liquid nozzle row 42, and the number of the cleaning liquid nozzle rows 42 are arbitrary irrespective of an example illustrated in FIG. 2. In addition, in FIG. 2, an example in which each nozzle row 40 is configured with one nozzle row, is illustrated, but each nozzle row 40 may be configured with a plurality of nozzle rows. The ink nozzle row 41 is an example of an "ink ejecting unit" of the invention. In addition, the cleaning liquid nozzle row 42 is an example of a "cleaning liquid ejecting unit" of the invention.

Returning to explanation of FIG. 1, the ink cartridge 25 stores ink for each ink color and supplies ink to the head 24 via the ink supply flow path 26. The cleaning liquid cartridge 27 stores the cleaning liquid, and supplies the cleaning liquid to the head 24 via the cleaning liquid supply flow path 28. The cleaning liquid cartridge 27 is an example of a "cleaning liquid storage unit" of the invention.

The suction unit 30 performs suction of ink and the cleaning liquid, and is provided at a home position where the print medium 6 and the head 24 do not face each other. The suction unit 30 includes a suction cap 31, an elevating device 32, a maintenance motor 33, a waste liquid flow path 34, a suction pump 35, a suction motor 36, and a waste liquid storage unit 37. The suction unit 30 is an example of a "cleaning unit" of the invention.

A dry prevention cap for suppressing the evaporation of ink in the nozzle at the time of printing pause, a wiper for wiping ink from the nozzle forming surface 24*a*, a flushing box for receiving the ink ejected from the head 24 and the like may be provided at the home position in addition to the suction unit 30.

The suction cap 31 seals the nozzles in units of the nozzle row 40. The suction cap 31 is a cap for sucking the ink from the ink nozzle row 41 in order to prevent clogging of the nozzle due to thickening of ink. In addition, the suction cap 31 is used for sucking the cleaning liquid from the cleaning liquid nozzle row 42. The elevating device 32 elevates and moves the suction cap 31 in a Z direction (in a vertical direction in FIG. 1) between a contact position where the suction cap 31 can contact the nozzle forming surface 24*a* of the head 24 and a non-contact position where it does not contact the nozzle forming surface 24*a*, by driving force of the maintenance motor 33. Accordingly, it is possible to suck ink and the cleaning liquid for each nozzle row selectively. In addition, in a case of a nozzle row unit, a plurality of nozzle rows may be capped and sucked. At this time, nozzle rows of different ink types may be simultaneously sucked.

One end of the waste liquid flow path 34 is connected to the suction cap 31 and the suction pump 35 for generating the negative pressure in the waste liquid flow path 34 is provided in the middle of the waste liquid flow path 34. The suction pump 35 sucks ink and the cleaning liquid by the driving force of the suction motor 36. The waste liquid storage unit 37 stores the ink and the cleaning liquid sucked by the suction pump 35. In the present embodiment, it is assumed that the waste liquid flow path 34 indicates a flow path from the suction cap 31 to the waste liquid storage unit 37.

The control unit 10 drives and controls the carriage motor 22*d*, the head 24, the maintenance motor 33, the suction motor 36, and the like such that a printing process and a maintenance process are performed. As the maintenance process, a cleaning process of cleaning the head 24 by sucking ink and the cleaning process of cleaning the waste liquid flow path 34 by sucking the cleaning liquid, are performed.

Here, the maintenance process will be simply described. First, the cleaning process will be described. For example, if the cleaning process is instructed by a user, the cleaning process is performed when a predetermined time elapses from when the previous cleaning process is performed.

When the cleaning process starts and the carriage motor 22*d* is driven, and then the control unit 10 causes the carriage 21 to stop at a position where the ink nozzle row 41 to be a cleaning target and the suction cap 31 are positioned to oppose each other, among the ink nozzle rows 41 formed on the nozzle forming surface 24*a*. The control unit 10 causes the suction cap 31 to be elevated up and moved to a contact position by driving the maintenance motor 33.

The control unit 10 causes the suction pump 35 to be driven by the suction motor 36, and ink to be sucked from the nozzle of the ink nozzle row 41 which is the cleaning target. The sucked ink is discharged to the waste liquid storage unit 37 via the waste liquid flow path 34. At this time, some of the ink remains in the waste liquid flow path 34. Viscosity of the remaining ink increases by drying with the passage of time and the ink is solidified. In the cleaning process, an operation in which the suction unit 30 sucks ink from nozzles of respective ink nozzle rows 41, is referred to as an "ink suction operation".

Next, the cleaning process will be described. The printer 1 of the present embodiment performs the cleaning process when a reference time elapses from when the ink suction process is performed. The reference time may be a predetermined time and may be a time designated by the user. In addition, for example, in a case where the reference time is the predetermined time, a length of the reference time is 12 hours.

When the cleaning process starts, the control unit 10 causes the carriage motor 22*d* to be driven and then the control unit 10 causes the carriage 21 to stop at a position where the cleaning liquid nozzle row 42 formed on the nozzle forming surface 24*a* and the suction cap 31 are positioned to oppose each other. The control unit 10 causes the suction cap 31 to be elevated up and moved to the contact position by driving the maintenance motor 33.

The control unit 10 operates the suction pump 35 by driving the suction motor 36, and sucks the cleaning liquid from a nozzle of the cleaning liquid nozzle row 42. The sucked cleaning liquid is discharged to the waste liquid storage unit 37 via the waste liquid flow path 34. By the suction of cleaning liquid, the ink remaining in the waste liquid flow path 34 is dissolved by the cleaning liquid and an inside of the waste liquid flow path 34 is cleaned. In the cleaning process, an operation in which the suction unit 30 sucks the cleaning liquid from the nozzle of the cleaning liquid nozzle row 42, is referred to as a "cleaning operation".

When the cleaning operation is performed, the control unit 10 causes driving control of the suction motor 36 to be performed to vary a suction amount of the cleaning liquid depending on a color of the ink sucked by the ink suction operation. More specifically, since the white ink which is the base ink among the cyan, magenta, yellow, white, and black inks, is quickly increasing in viscosity and easy to dry and to solidify, as compared with ink of other colors, in a case where the white ink is sucked, it is controlled to increase the suction amount of the cleaning liquid as compared with a case where the white ink is not sucked. Details will be described below.

Next, with reference to FIG. 3, a control system of the printer 1 will be described. The printer 1 includes the control unit 10, a temperature sensor 15, an interface 16, an operation panel 17, a power switch 18, the carriage motor 22*d*, the head 24, the maintenance motor 33, and the suction motor 36 as the control system, and they are connected to each other via a bus 19.

The control unit 10 includes a central processing unit (CPU) 11, a read-only memory (ROM) 12, a random access memory (RAM) 13, and a timer 14. The CPU 11 performs inputting and outputting of signals to each unit in the printer 1 via the bus 19, and is a processor of performing various calculation processes. The processor may be configured with a plurality of CPUs, and may be configured with a hardware circuit such as an application specific integrated circuit (ASIC). The ROM 12 is a non-volatile storage medium and stores programs such as firmware.

The RAM 13 is a volatile storage medium and is used as a work area of the CPU 11. In addition, the RAM 13 includes a log storage area 13*a* of storing an operation log of the printer 1. A date at which turn ON and OFF of power source of the printer 1, the printing process, the cleaning process, the cleaning process, and the like are performed, is stored in the log storage area 13*a*. More specifically, cleaning information including an ink color corresponding to the ink nozzle row 41 to be a target of the cleaning process and a date and a time at which the ink suction operation is completed in the cleaning process, is stored in the log storage area 13*a*.

The timer 14 counts a date and a time required for recording of an operation log. In addition, the timer 14 is used for determining a performance timing of the cleaning process. That is, the timer 14 starts counting of an elapsed time from a time at which the first ink suction operation is completed after an initial activation or after the previous cleaning operation in the printer 1. When a counted value of the timer 14 reaches the reference time, that is, when the reference time elapses from when the ink suction operation is performed, the printer 1 performs the cleaning process. A start timing of the counting of the timer 14 may be a time at which the ink suction operation starts instead of the time at which the ink suction operation is completed. In addition, when the cleaning process is completed, the timer 14 resets the counted value.

The temperature sensor 15 is attached to the head 24, and detects an abnormal temperature of the head 24. In a case where the abnormal temperature is detected by the temperature sensor 15, the control unit 10 causes error notification and a power disconnection process to be performed. The temperature sensor 15 is an example of an "acquisition unit" of the invention.

The interface 16 is a communication unit for performing communication with an external device 100, for example, the reception of various types of information including a print job from the external device 100 and the like. For example, it is possible to use a personal computer as the external device 100.

For example, the operation panel 17 is a display to which a touch sensor is attached, and is used as an operation unit and a display unit. For example, the operation panel 17 is used for setting a printing mode. In the present embodiment, it is possible to set anyone printing mode of a white mode in which white ink is used and a non-white mode in which the white ink is not used. For example, the white ink is used for forming a white base in a case where the print medium 6 is a dark-colored fabric such as black color.

The power switch 18 is the operation unit for switching the turn ON and OFF of the power source of the printer 1.

The carriage motor 22*d*, the head 24, the maintenance motor 33, and the suction motor 36 are driven and controlled by the control unit 10 as described above.

Figure 4:
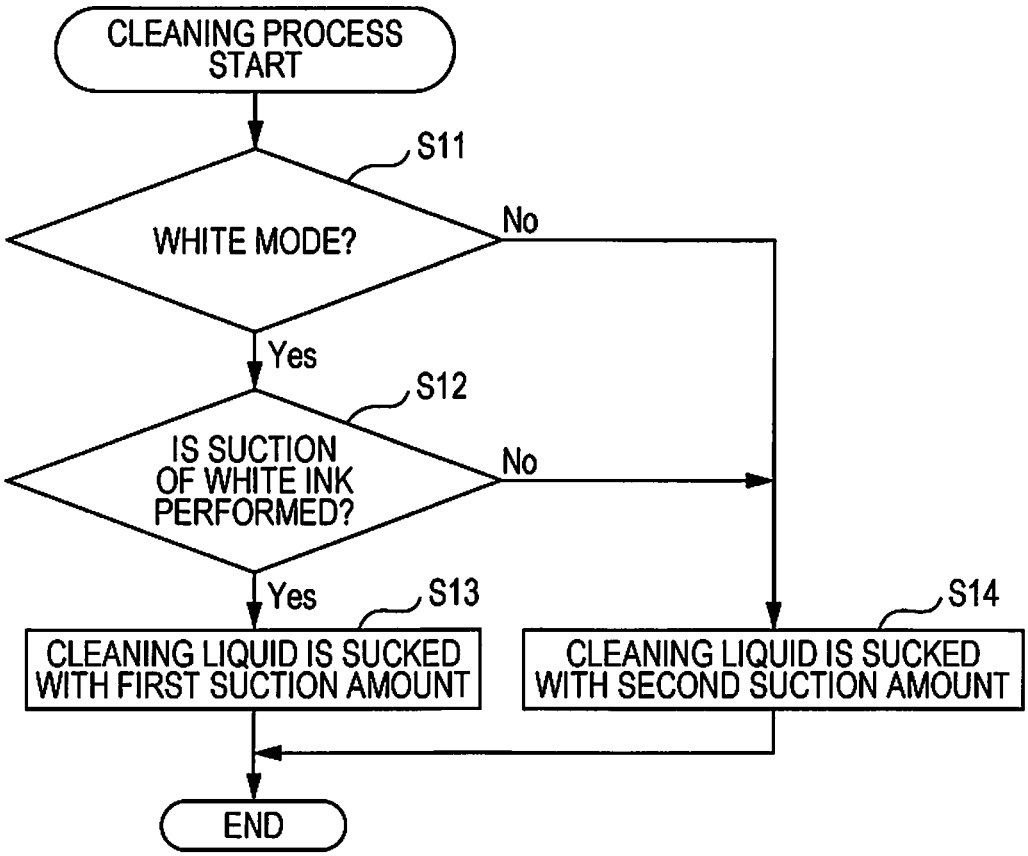
FIG. 4 is a flowchart illustrating a cleaning process according to a first embodiment.

Next, with reference to a flowchart of FIG. 4, the cleaning process of the printer 1 according to a first embodiment will be described. When the cleaning process starts, the printer 1 determines whether or not a mode is set in the white mode (S11). In a case where it is determined that the mode is set in the white mode (S11: Yes), the printer 1 determines whether or not the suction of the white ink is performed (S12). Here, it is determined whether or not the white ink is sucked by the ink suction operation performed after the initial activation or after the previous cleaning operation in the printer 1, based on the cleaning information stored in the log storage area 13*a*. The determination of the printing mode in S11 and determination of the presence or absence of the suction of the white ink in S12 are examples of determination as to whether or not the "suction of specific ink is performed" in the invention.

In a case where it is determined that the suction of the white ink is performed (S12: Yes), the printer 1 performs the suction of cleaning liquid with the first suction amount (S13). Meanwhile, in a case where it is determined that the mode is not in the white mode (S11: No) and in a case where it is determined that the suction of the white ink is not performed (S12: No), the printer 1 performs the suction of cleaning liquid with the second suction amount smaller than the first suction amount (S14).

The printer 1 adjusts the suction amount of the cleaning liquid by a time at which the suction motor 36 rotates. That is, the printer 1 causes a rotation time of the suction motor 36 in a case where the suction of cleaning liquid is performed with the first suction amount (S13), to be lengthened more than that in a case where the suction of cleaning liquid is performed with the second suction amount (S14).

As described above, according to the printer 1 of the present embodiment, when the cleaning operation is performed, depending on the color of ink sucked by the ink suction operation, since the suction unit 30 is controlled to vary the suction amount of the cleaning liquid, it is possible to clean the waste liquid flow path 34 with an amount of the cleaning liquid suitable for the color of ink. By doing this, it is possible to suppress the excessive use of the cleaning liquid, and it is possible to suppress the use amount of the cleaning liquid, as a result.

In addition, when the cleaning operation is performed, after the initial activation or after the previous cleaning operation in the printer 1, the printer 1 can determine whether or not the suction of the white ink is performed, and can effectively suppress the use amount of the cleaning liquid by a simple determination process to vary the suction amount of the cleaning liquid according to the determined result.

In addition, since the printer 1 performs the ejecting of ink and the supply of the cleaning liquid with a single head 24, it is possible to simplify a device configuration as compared with a case where performing in respective heads 24. In addition, since the printer 1 performs the suction of ink and the suction of cleaning liquid by a common suction unit 30, it is possible to simplify a device configuration as compared with a case where performing in respective suction units 30.

Second Embodiment

Next, a second embodiment of the invention will be described. In the above-described first embodiment, the suction unit 30 is controlled to vary the suction amount of the cleaning liquid depending on the color of the ink sucked by the ink suction operation, but the suction unit 30 may be controlled to vary the suction amount of the cleaning liquid depending on the elapsed time from when the ink suction operation is performed. Hereinafter, only the differences from the first embodiment will be described. In the present embodiment, components similar to those of the first embodiment are denoted by the same reference numerals, and a detailed description thereof will be omitted. In addition, a modification example applied to the same configuration parts as the first embodiment is similarly applied to the present embodiment.

Figures 5, 6:
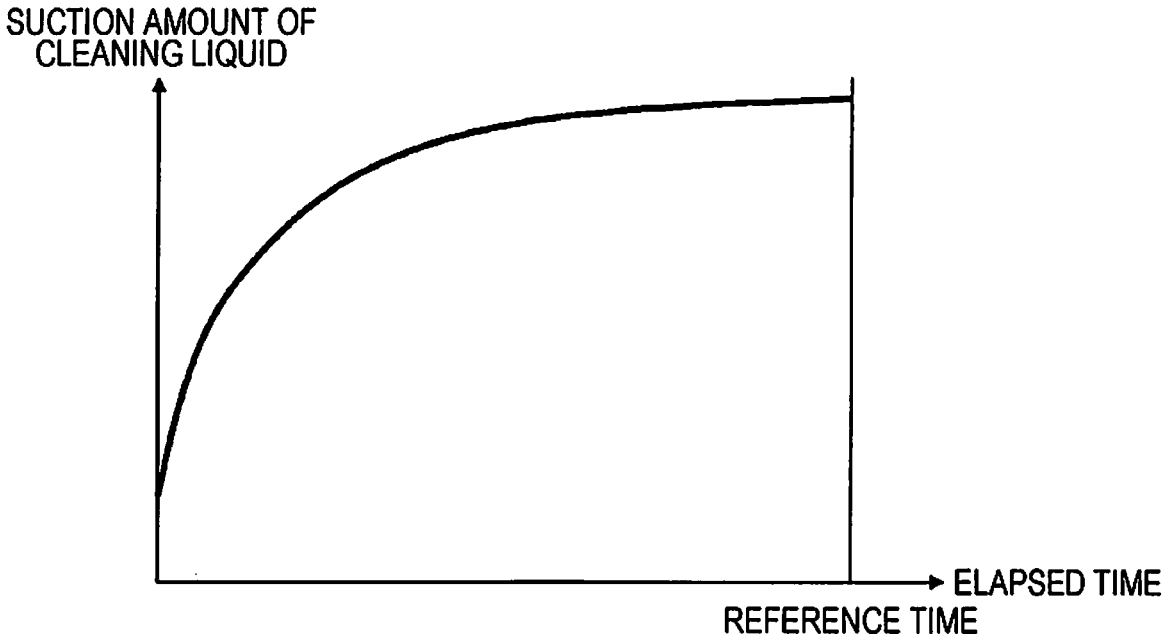
FIG. 5 is an explanatory diagram of a cleaning process according to a second embodiment.
FIG. 6 is a graph illustrating a relationship between an elapsed time from when an ink suction operation is performed and a suction amount of the cleaning liquid according to the second embodiment.

FIG. 5 is an explanatory diagram of a cleaning process according to the second embodiment. Similar to the first embodiment, in addition to the cleaning operation (hereinafter, it is referred to as "regular cleaning operation") performed when the reference time elapses from when the ink suction operation is performed, the printer 1 of the invention performs the cleaning operation (hereinafter, it is referred to as "temporal cleaning operation") performed when a trigger for starting the cleaning operation is generated before the reference time elapses. For example, the trigger for starting the cleaning operation is power OFF, a cleaning instruction operation, or the like. As a situation in which the power OFF is performed, it is considered that a case where the power switch 18 is operated by the user, a case where a power OFF instruction is received from the external device 100, the power OFF is voluntarily performed in the printer 1, and the like. Although the cleaning instruction operation is performed by using the operation panel 17, in a case where a cleaning instruction is received from the external device 100, the cleaning process assuming that the third trigger of starting the cleaning operation occurs, may be performed.

The printer 1 sets the suction amount of the cleaning liquid in the regular cleaning operation as the first suction amount. The first suction amount corresponds to the maximum amount of the cleaning liquid sucked in the cleaning operation. In addition, the first suction amount is an example of a "reference supply amount" of the invention. The printer 1 sets the suction amount of the cleaning liquid in a temporal cleaning operation as the third suction amount. The third suction amount is the suction amount smaller than the first suction amount. The third suction amount may be a predetermined suction amount, and may be the suction amount determined depending on the elapsed time from when the ink suction operation is performed. Hereinafter, the former is referred to as a "fixed value" and the latter is referred to as a "variable value".

Here, with reference to FIG. 6, a method of determining the suction amount of the cleaning liquid in a case of the third suction amount as the variable value, will be described. A horizontal axis of a graph in FIG. 6 indicates the elapsed time from when the ink suction operation is performed, and a vertical axis indicates the suction amount of the cleaning liquid. The elapsed time from when the ink suction operation is performed, is counted up by the timer 14. As illustrated in FIG. 6, when determining the third suction amount, the printer 1 determines the third suction amount to increase the suction amount of the cleaning liquid as the elapsed time from when the ink suction operation is performed is lengthened. In FIG. 6, although the third suction amount increases in a curved manner with respect to the elapsed time, the third amount may be increased in a stepwise manner or may be linearly increased.

As described above, according to the printer 1 of the present embodiment, in the temporal cleaning operation performed before a reference period elapses, since the suction unit 30 is controlled to be the suction amount smaller than a reference suction amount that is the suction amount of the cleaning liquid in the regular cleaning operation performed when the reference time elapses, it is possible to suppress the use amount of the cleaning liquid as compared with a case of the regular cleaning operation.

In addition, in a case where the third suction amount that is the suction amount of the cleaning liquid, is set as the variable value in the temporal cleaning operation, since the suction amount of the cleaning liquid is determined depending on the elapsed time from when the ink suction operation is performed, it is possible to clean the waste liquid flow path 34 by the cleaning liquid of an amount suitable for the elapsed time.

Third Embodiment

Next, a third embodiment of the invention will be described. The third embodiment is a combination of the first embodiment and the second embodiment. Also, in the present embodiment, the same reference numerals are given to the same configuration parts as those in each of the above-described embodiments, and a detailed description thereof will be omitted. In addition, the modification example applied to the same configuration parts as those in each of the above embodiments are similarly applied to the present embodiment.

When the cleaning operation is performed, the printer 1 of the present embodiment determines the suction amount of the cleaning liquid depending on the color of the ink sucked by the ink suction operation and the elapsed time from when the ink suction operation is performed. In the present embodiment, a determining method of the third suction amount that is the suction amount of the cleaning liquid in the temporal cleaning operation is different when compared with the second embodiment. For example, in a case where the third suction amount is set as the fixed value in the printer 1, the suction amount of the cleaning liquid of a case where the white ink is sucked, is greater than that of a case where the white ink is not sucked by the ink suction operation. Meanwhile, in a case where the third suction amount is set as the variable value, the printer 1 determines the suction amount of the cleaning liquid according to a graph illustrated in FIG. 7.

Figure 7:
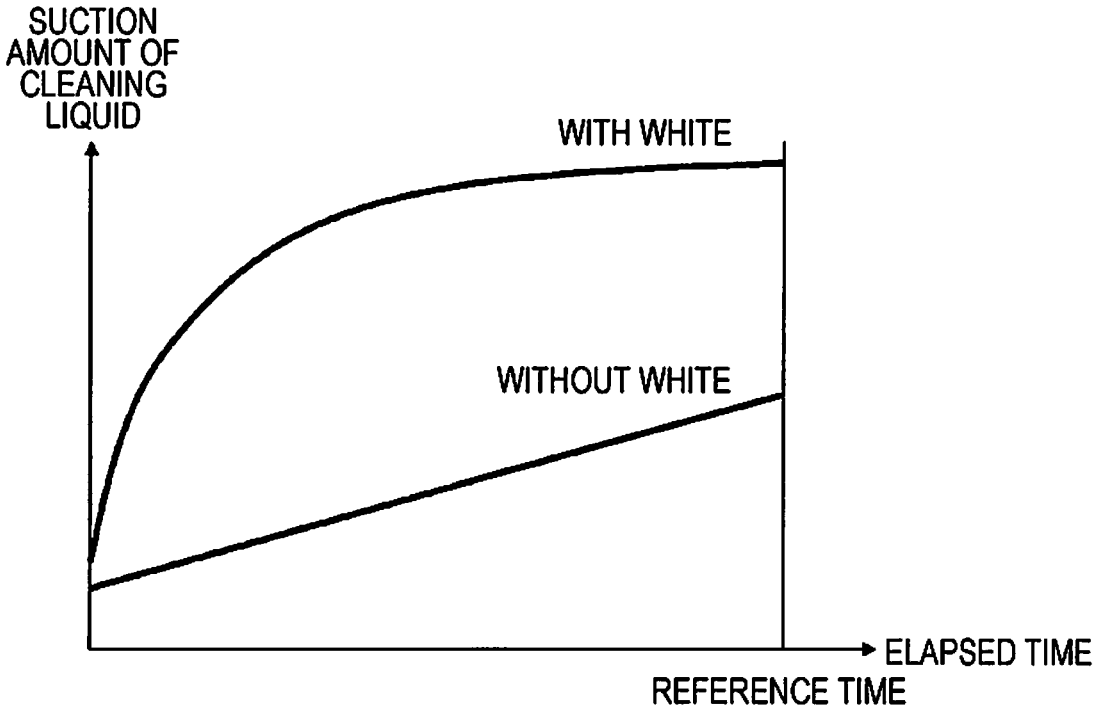
FIG. 7 is a graph illustrating a relationship between an elapsed time from when the ink suction operation is performed and a suction amount of the cleaning liquid according to a third embodiment.

FIG. 7 is a graph indicating the suction amount of the cleaning liquid in a case where the third suction amount is set as the variable value. As illustrated in FIG. 7, in a case where the white ink is sucked, the third suction amount increases in a curved manner with respect to the elapsed time. Meanwhile, in a case where the white ink is not sucked, the third suction amount linearly increases with respect to the elapsed time.

As described above, according to the printer 1 of the present embodiment, when the cleaning operation is performed, since the suction unit 30 is controlled to vary the suction amount of the cleaning liquid, depending on the color of ink sucked by the ink suction operation and the elapsed time from when the ink suction operation is performed, it is possible to clean the waste liquid flow path 34 by the cleaning liquid of an amount suitable for the color of ink and the elapsed time. With this, by comparing the first embodiment and the second embodiment, it is possible to more effectively suppress the use amount of the cleaning liquid.

Fourth Embodiment

Next, a fourth embodiment of the invention will be described. In the fourth embodiment, depending on an environment temperature, the suction unit 30 is controlled to vary the suction amount of the cleaning liquid. Also, in the present embodiment, the same reference numerals are given to the same configuration parts as those in each of the above-described embodiments, and a detailed description thereof will be omitted. In addition, the modification example applied to the same configuration parts as those in each of the above embodiments are similarly applied to the present embodiment.

Figure 3:
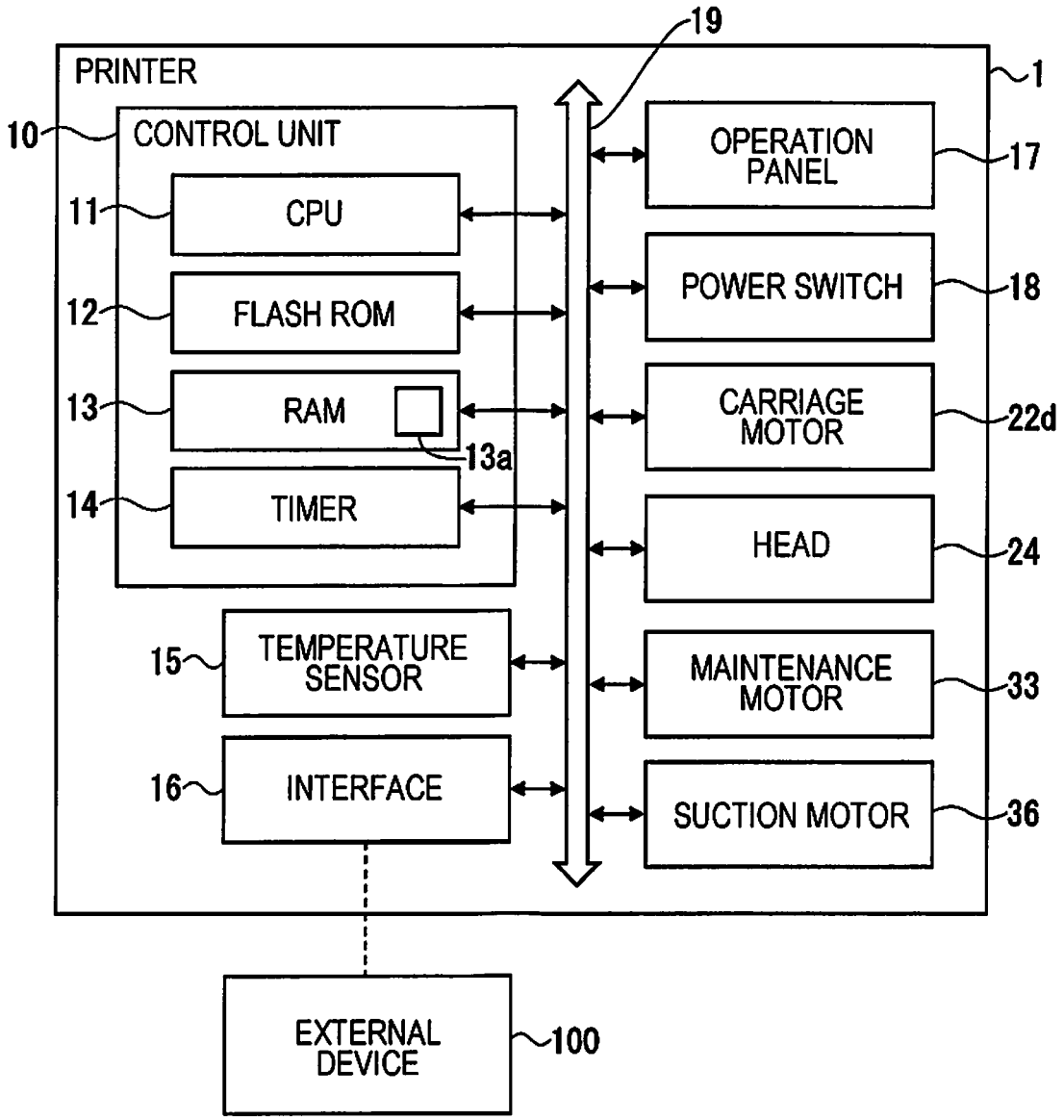
FIG. 3 is a block diagram illustrating a control system of the printer.

When the cleaning operation is performed, the printer 1 of the present embodiment determines the suction amount of the cleaning liquid depending on the color of ink sucked by the ink suction operation, the elapsed time from when the ink suction operation is performed, and the environment temperature detected by the temperature sensor 15 (see FIG. 3).

Although the temperature sensor 15 is attached to the head 24 in the first embodiment, the temperature sensor 15 may be provided in the waste liquid flow path 34, or may be attached to a housing of the printer 1. In addition, the printer 1 may acquire the environment temperature from the external device 100, or may acquire the environment temperature by user input through the operation panel 17, instead of including the temperature sensor 15.

In the printer 1 of the present embodiment, a determining method of the third suction amount that is the suction amount of the cleaning liquid in the temporal cleaning operation when compared with the third embodiment, is different. In a case where the third suction amount is determined, the printer 1 determines the suction amount of the cleaning liquid to be the suction amount of the cleaning liquid in a case where the environment temperature is high, greater than that of a case where the environment temperature is low. This is because the higher the environment temperature, the higher a drying speed of ink and the easier it is to solidify.

In addition, in a case where the third suction amount is set as the fixed value, the printer 1 determines the suction amount of the cleaning liquid according to which of a plurality of temperature ranges the environment temperature is included in. For example, the printer 1 may determine the suction amount of the cleaning liquid according to which of a first temperature range, a second temperature range, and a third temperature range the environment temperature is included. The first temperature range is a temperature range higher than the second temperature range, and the second temperature range is a temperature range higher than the third temperature range. The setting of each temperature range is not specifically limited. However, for example, it is considered that the first temperature range is "equal to or greater than 35° C.", the second temperature range is "equal to or greater than 10° C. and less than 35° C.", the third temperature range "less than 10° C.", and the like. In this case, the printer 1 determines the third suction amount so as to be the suction amount in a case where the environment temperature is included in the first temperature range > the suction amount in a case where the environment temperature is included in the second temperature range > the suction amount in a case where the environment temperature is included in the third temperature range.

Figure 8:
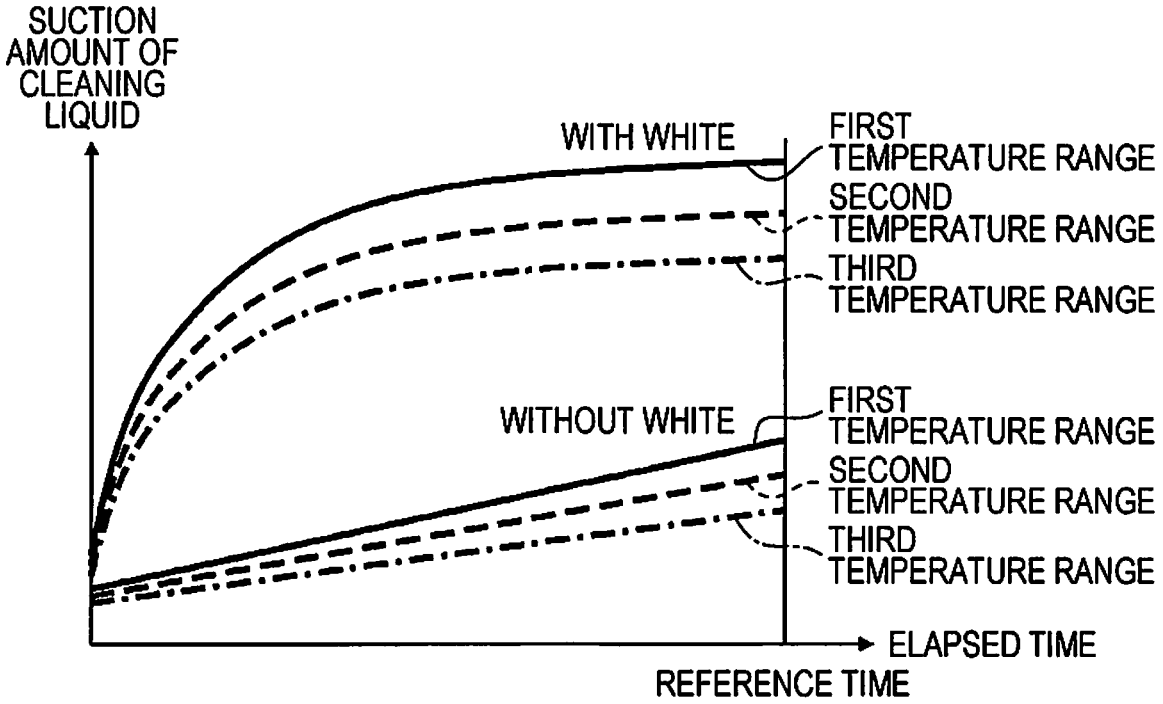
FIG. 8 is a graph illustrating a relationship between an elapsed time from when the ink suction operation is performed and a suction amount of the cleaning liquid according to a fourth embodiment.

Meanwhile, in a case where the third suction amount is set as the variable value, the printer 1 determines the suction amount of the cleaning liquid according to a graph illustrated in FIG. 8. Also, in a case where the third suction amount is set as the variable value, the printer 1 determines the suction amount of the cleaning liquid according to which of three temperature ranges the environment temperature is included in. FIG. 8 is a graph illustrating the suction amount of the cleaning liquid in a case where the third suction amount is set as the variable value. As illustrated in FIG. 8, in a case where the white ink is sucked and in a case where the white ink is not sucked, the printer 1 increases the difference in the suction amount of the cleaning liquid required in each temperature range as the elapsed time is lengthened.

As described above, according to the printer 1 of the present embodiment, when the cleaning operation is performed, since the suction unit 30 is controlled to vary the suction amount of the cleaning liquid depending on the color of ink sucked by the ink suction operation, the elapsed time from when the ink suction operation is performed, and the environment temperature, it is possible to clean the waste liquid flow path 34 by the cleaning liquid of the amount suitable for the color of ink, the elapsed time, and the environment temperature. With this, when compared with the first embodiment, the second embodiment, and the third embodiment, it is possible to more effectively suppress the use amount of the cleaning liquid.

So far, although the first to fourth embodiments are described, the following modification examples can for example be adopted regardless of these embodiments.

Modification Example 1

In the first embodiment, although the printer 1 controls the suction unit 30 so as to vary the suction amount of the cleaning liquid depending on the color of the ink sucked by the ink suction operation, the printer 1 may vary a suction amount of the cleaning liquid according to an element other than the color of ink. For example, even in the same ink color, the suction amount of the cleaning liquid may be varied depending on a composition of the ink. The composition of the ink can be distinguished by solvent, color materials, resins, additives, or the like of the ink which is a component of the ink.

Modification Example 2

In addition, in the first embodiment, although the printer 1 determines the printing mode and the color of ink sucked by the ink suction operation, and processes to vary a suction amount of the cleaning liquid according to the determined result, the suction amount of the cleaning liquid may be varied according to only the determined result of the printing mode. In this case, in a case where it is determined that a mode is the white mode, the printer 1 sucks the cleaning liquid with the first suction amount, and in a case where it is determined that the mode is a non-white mode, the cleaning liquid may be sucked with the second suction amount smaller than the first suction amount. In addition, as a further modification example, it may be processed the suction amount of the cleaning liquid to vary an amount according to the determined result of only the color of the ink sucked by the ink suction operation without performing the determination of the printing mode.

Modification Example 3

In the above-described second embodiment, although the printer 1 performs the cleaning process by the elapse of the reference time, the power OFF, and the cleaning instruction operation as the trigger, the cleaning process may be performed when the trigger of the cleaning process other than these is generated. In this case, the suction amount of the cleaning liquid may be the third suction amount and the third suction amount may be the fixed value or may be the variable value. In addition, the printer 1 may control the suction unit 30 to vary the third suction amount according to the generated trigger. For example, it is considered as the trigger of the cleaning process when the abnormal temperature of the head 24 is detected, when the ink is initially filled, or the like.

Modification Example 4

In the fourth embodiment, when the cleaning operation is performed, although the printer 1 processes to vary a suction amount of the cleaning liquid depending on the color of ink sucked by the ink suction operation, the elapsed time from when the ink suction operation is performed, and the environment temperature, the elapsed time may be not considered. That is, the printer 1 may determine the suction amount of the cleaning liquid depending on the color of ink sucked by the ink suction operation and the environment temperature. In this case, in each graph of FIG. 8, the printer 1 may suck the cleaning liquid with the suction amount when the elapsed time reaches the reference time.

Modification Example 5

In addition, in the fourth embodiment, the color of ink sucked by the ink suction operation may be not considered. That is, the printer 1 may determine the suction amount of the cleaning liquid depending on the elapsed time from when the ink suction operation is performed and the environment temperature. In this case, the printer 1 may determine the suction amount of the cleaning liquid according to a graph in a case where the white ink of FIG. 8 is sucked. In addition, as a further modification example, the printer 1 may determine the suction amount of the cleaning liquid depending on only the environment temperature. In this case, in a graph of FIG. 8, the printer 1 may suck the cleaning liquid with the suction amount when the elapsed time reaches the reference time in a case where the white ink is sucked.

Modification Example 6

In each embodiment described above, although the printer 1 performs the cleaning process when the reference time elapses from when the first ink suction operation is performed after the initial activation or after the previous cleaning operation, this timing is not necessarily required. For example, the cleaning process may be performed when the reference time elapses from when the last ink suction operation is performed after the initial activation or after the previous cleaning operation in the printer 1. That is, in a case where the ink suction operation starts while the timer 14 is counting, a count value of the timer 14 may be reset.

Modification Example 7

In each embodiment described above, although the plurality of ink nozzle rows 41 and one cleaning liquid nozzle row 42 are provided in the single head 24, the ink nozzle row 41 and the cleaning liquid nozzle row 42 may be provided in different heads 24.

Modification Example 8

In each embodiment described above, a downstream end of a supply flow path connected to the cleaning liquid storage unit, is connected between the suction cap 31 and the suction pump 35 of the waste liquid flow path 34, and the suction unit 30 may suck the cleaning liquid from the cleaning liquid storage unit via the supply flow path instead of suctioning the cleaning liquid from the cleaning liquid nozzle row 42. In addition, although the suction unit 30 functions as the "cleaning unit" of the invention by sucking the cleaning liquid from the cleaning liquid cartridge 27 via the waste liquid flow path 34, the cleaning unit that performs the cleaning operation by which the cleaning liquid is supplied from the cleaning liquid storage unit to the waste liquid flow path 34, may be provided in the printer 1 apart from the suction unit 30. For example, a configuration in which the cleaning unit includes the cleaning liquid storage unit and a liquid feed unit that presses and feeds the cleaning liquid from the cleaning liquid storage unit to the waste liquid flow path 34 via the supply flow path, may be adopted.

Other Modification Example

A method for performing each process of the printer 1 shown in each of the above embodiments and modification examples, a program for executing each process of the printer 1 by the CPU 11, and a computer-readable recording medium in which the program is recorded, are included in the scope of the invention. In addition, although the printer 1 is exemplified as an example of the liquid ejecting apparatus, the invention may be applied to an apparatus other than the printer 1 that ejects liquid to a medium. Besides, it is possible to appropriately vary the invention within a range not deviating from the gist of the invention.

This application claims priority under 35 U.S.C. § 119 to Japanese Patent Application No. 2018-015465, filed Jan. 31 2018. The entire disclosure of Japanese Patent Application No. 2018-015465 is hereby incorporated herein by reference.

What is claimed is:

1. A liquid ejecting apparatus comprising:

an ink ejecting unit that ejects ink from a nozzle;

a waste liquid flow path that is a flow path of the ink sucked from the nozzle;

a suction unit that performs an ink suction operation of sucking the ink from the nozzle via the waste liquid flow path;

a cleaning unit that performs a cleaning operation of supplying cleaning liquid from a cleaning liquid storage unit that stores the cleaning liquid to the waste liquid flow path; and a control unit that controls the cleaning unit so that a supply amount of the cleaning liquid varies depending on an elapsed time from when the ink suction operation was last performed, when the cleaning operation is again performed, wherein the control unit causes the cleaning unit to perform the cleaning operation with a reference supply amount when a reference time elapses from when the ink suction operation was last performed, and causes the cleaning unit to perform the cleaning operation with a supply amount smaller than the reference supply amount when a trigger for starting the cleaning operation is generated, before the reference time elapses.

2. The liquid ejecting apparatus according to claim 1, wherein the trigger for starting the cleaning operation is at least one of power OFF of the liquid ejecting apparatus and an operation for starting the cleaning operation.

3. The liquid ejecting apparatus according to claim 1, wherein the suction unit functions as the cleaning unit by sucking the cleaning liquid from the cleaning liquid storage unit via the waste liquid flow path.

4. The liquid ejecting apparatus according to claim 3, further comprising:

a cleaning liquid ejecting unit that ejects the cleaning liquid from the nozzle, wherein the suction unit sucks the cleaning liquid from the nozzle of the cleaning liquid ejecting unit via the waste liquid flow path.

5. The liquid ejecting apparatus according to claim 4, wherein the ink ejecting unit and the cleaning liquid ejecting unit are provided in a single head.

6. The liquid ejecting apparatus according to claim 1, further comprising:

an acquisition unit that acquires an environment temperature, wherein the control unit controls the cleaning unit so that the supply amount of the cleaning liquid varies depending on the acquired environment temperature.

* * * * *